US008087452B2

(12) United States Patent
Goldman et al.

(10) Patent No.: US 8,087,452 B2
(45) Date of Patent: Jan. 3, 2012

(54) CONTACT COOLING DEVICE

(75) Inventors: Richard Goldman, Stoughton, MA (US); Boris Akselband, Brighton, MA (US); Charles Gerbutavich, Salem, MA (US); Charles Carswell, Weston, MA (US)

(73) Assignee: Lytron, Inc., Woburn, MA (US)

( * ) Notice: Subject to any disclaimer, the term of this patent is extended or adjusted under 35 U.S.C. 154(b) by 1086 days.

(21) Appl. No.: 11/230,258

(22) Filed: Sep. 19, 2005

(65) Prior Publication Data

US 2006/0108100 A1 May 25, 2006

Related U.S. Application Data

(63) Continuation-in-part of application No. 10/412,753, filed on Apr. 11, 2003, now abandoned.

(60) Provisional application No. 60/371,883, filed on Apr. 11, 2002.

(51) Int. Cl.
*H05K 7/20* (2006.01)

(52) U.S. Cl. ..... 165/80.4; 165/170; 361/699

(58) Field of Classification Search ..... 165/80.4, 165/170; 361/699
See application file for complete search history.

(56) References Cited

U.S. PATENT DOCUMENTS

| | | | | | |
|---|---|---|---|---|---|
| 1,662,870 | A * | 3/1928 | Stancliffe | 165/166 |
| 3,139,392 | A | 6/1964 | Mears | 430/314 |
| 4,119,140 | A | 10/1978 | Cates | |
| 4,932,469 | A * | 6/1990 | Beatenbough | 165/153 |
| 4,975,803 | A * | 12/1990 | Niggemann | 361/700 |
| 5,086,837 | A | 2/1992 | Hagemeister | |
| 5,125,453 | A | 6/1992 | Betrand et al. | |
| 5,249,359 | A * | 10/1993 | Schubert et al. | 29/890.039 |
| 5,423,376 | A * | 6/1995 | Julien et al. | 165/80.4 |
| 5,429,183 | A | 7/1995 | Hisamori et al. | 165/134.1 |
| 5,586,598 | A * | 12/1996 | Tanaka et al. | 165/133 |
| 5,826,646 | A * | 10/1998 | Bae et al. | 165/110 |
| 5,947,365 | A * | 9/1999 | Tanaka et al. | 228/136 |
| 5,987,893 | A | 11/1999 | Schulz-Harder et al. | 62/3.7 |
| 6,129,147 | A | 10/2000 | Dumetz et al. | 165/177 |
| 6,167,952 | B1 * | 1/2001 | Downing | 165/167 |
| 6,321,998 | B1 * | 11/2001 | Schubert et al. | 239/8 |
| 6,345,665 | B1 * | 2/2002 | Schulz-Harder | 165/80.4 |
| 6,446,715 | B2 * | 9/2002 | Watanabe et al. | 165/177 |
| 6,536,516 | B2 * | 3/2003 | Davies et al. | 165/170 |
| 6,742,574 | B2 | 6/2004 | Sugito et al. | 165/104.21 |
| 6,907,921 | B2 * | 6/2005 | Insley et al. | 165/170 |
| 2001/0000879 | A1 | 5/2001 | Sugawara et al. | |

* cited by examiner

*Primary Examiner* — Allen Flanigan
(74) *Attorney, Agent, or Firm* — Weingarten, Schurgin, Gagnebin & Lebovici LLP

(57) ABSTRACT

A high performance cold plate cooling device including multiple, relatively thin plates, each having patterns formed thereon that, as arranged within the device, cause turbulence in a fluid passing within the cooling device. Adjacent plates within the cooling device are arranged such that fluid channels within their patterns are arranged crosswise. One or more barriers extending at least a portion of the length of the device separate the crosswise channels into two or more flow sections and increase uniformity of thermal performance over the active plate area. Manufacturing of the device includes stacking the plates in an alternating fashion such that the channels within the pattern of each plate are crosswise with respect to the channels in the pattern of an adjacent plate and adjacent barrier walls abut.

8 Claims, 7 Drawing Sheets

CONTACT COOLING DEVICE

CROSS REFERENCE TO RELATED APPLICATIONS

This application claims priority under 35 U.S.C. §119(e) to U.S. Provisional Patent Application No. 60/371,883, entitled "Contact Cooling Device," filed Apr. 11, 2002, the disclosure of which is incorporated by reference herein.

This application is a continuation-in-part of U.S. patent Ser. No. 10/412,753, entitled "Contact Cooling Device," filed Apr. 11, 2003 now abandoned, the disclosure of which is incorporated by reference herein.

STATEMENT REGARDING FEDERALLY SPONSORED RESEARCH OR DEVELOPMENT

N/A

BACKGROUND OF THE INVENTION

The present invention relates generally to a cooling apparatus and more specifically to a design for a contact cooling device operable to introduce turbulence into a cooling fluid for improved cooling characteristics.

As it is generally known, overheating of various types of electronic components may result in their failure or destruction. The need for effective heat removal techniques in this area is accordingly a basic problem. Various types of systems have been designed to cool electronic components in order to increase the MTBF (Mean Time Between Failure) of those components. In some existing systems, fluid has been passed through cold plates or heat sinks in order to transfer heat away from devices or components to be cooled. While such existing systems have sometimes been effective in certain applications, there is an ongoing need to provide improved thermal transfer characteristics in such devices.

Accordingly, it would be desirable to have a cooling device that provides improvements in thermal transfer characteristics over previous systems that have used fluid flows to facilitate cooling of attached or proximate electronic devices.

SUMMARY OF THE INVENTION

A high performance cooling device is disclosed, wherein the cooling device includes multiple, relatively thin plates, each having patterns formed thereon causing turbulence in a fluid passing within the cold plate. Adjacent ones of the plates within the device have their patterns shifted so that flow channels within the adjacent patterns crisscross each other, for example intersecting at some included angle within the range of 36 to 60 degrees. The plates therefore may be arranged such that adjacent plate patterns are effectively mirror images of each other.

In an illustrative embodiment, the plates within the cooling device are fabricated using relatively thin (0.040"-0.100") copper plates that have been photo-etched, stamped, forged, cast, or which have been processed or produced in some other fashion to produce an advantageous pattern. Channels within the pattern formed on the copper plates induce turbulent flow to a fluid passing within the cooling device to increase the overall thermal transfer performance of the device. In one embodiment, a two pass design is used, in which inlet and outlet fluid ports are located on one end of the device. Alternatively, the disclosed device could be embodied in a one pass design, in which the inlet and outlet ports are located on opposite ends of the device.

In another embodiment, separation barriers extend along the plate parallel to the direction of coolant flow, dividing the plate into two or more sections of crosswise flow channels. Separation barriers are particularly beneficial to increase uniformity of performance in wider plates in which the coolant may not become equally distributed over the full area of the plate.

In a preferred method of manufacturing the disclosed device, the plates are assembled by using a diffusion bonding process. The individual plates are stacked in an alternating fashion such that the channels of the patterns of adjacent plates are mirror images, for example criss-crossing at an included angle within the range of 36 to 60 degrees, or at some other suitable angle. A pair of end plates may be stacked at the top and bottom of the assembly, which may not have an etched pattern, or which may feature some other etched pattern than that of the interior plates, and which allow for fluid input and output ports. During operation of the disclosed device, the ports bring fluid in and out of the device. The fluid passing channels of the pattern may extend partly or completely across the width of the patterned plates.

During the disclosed process for making the disclosed device, the stacked plates are placed in a fixture and diffusion bonded in a vacuum or inert atmosphere. A mechanical load is applied to maintain contact pressure between the plates during this process. The fixture used for diffusion bonding the plates together can also be designed to provide for diffusion bonding various sized pads or blocks on the surface interfacing the components requiring cooling. In this way, a "custom topography" may be introduced to the surface interfacing with the components requiring cooling. Such an approach potentially eliminates an expensive machining operation.

Thus there is disclosed a new cooling device that provides improvements in thermal transfer characteristics over previous systems using fluid flows to facilitate cooling of attached or proximate electronic devices.

DESCRIPTION OF THE DRAWINGS

The invention will be more fully understood by reference to the following detailed description of the invention in conjunction with the drawings, of which.

DETAILED DESCRIPTION OF THE INVENTION

A high performance cooling device is disclosed, which may, for example, be fabricated using an assembly of relatively thin (0.040"-0.100") copper plates that each include a pattern having a number of fluid flow channels. The pattern may be formed on the patterned plates using any appropriate technique, for example by photo-etching, stamping, forging, casting or other processes.

Figure 1:
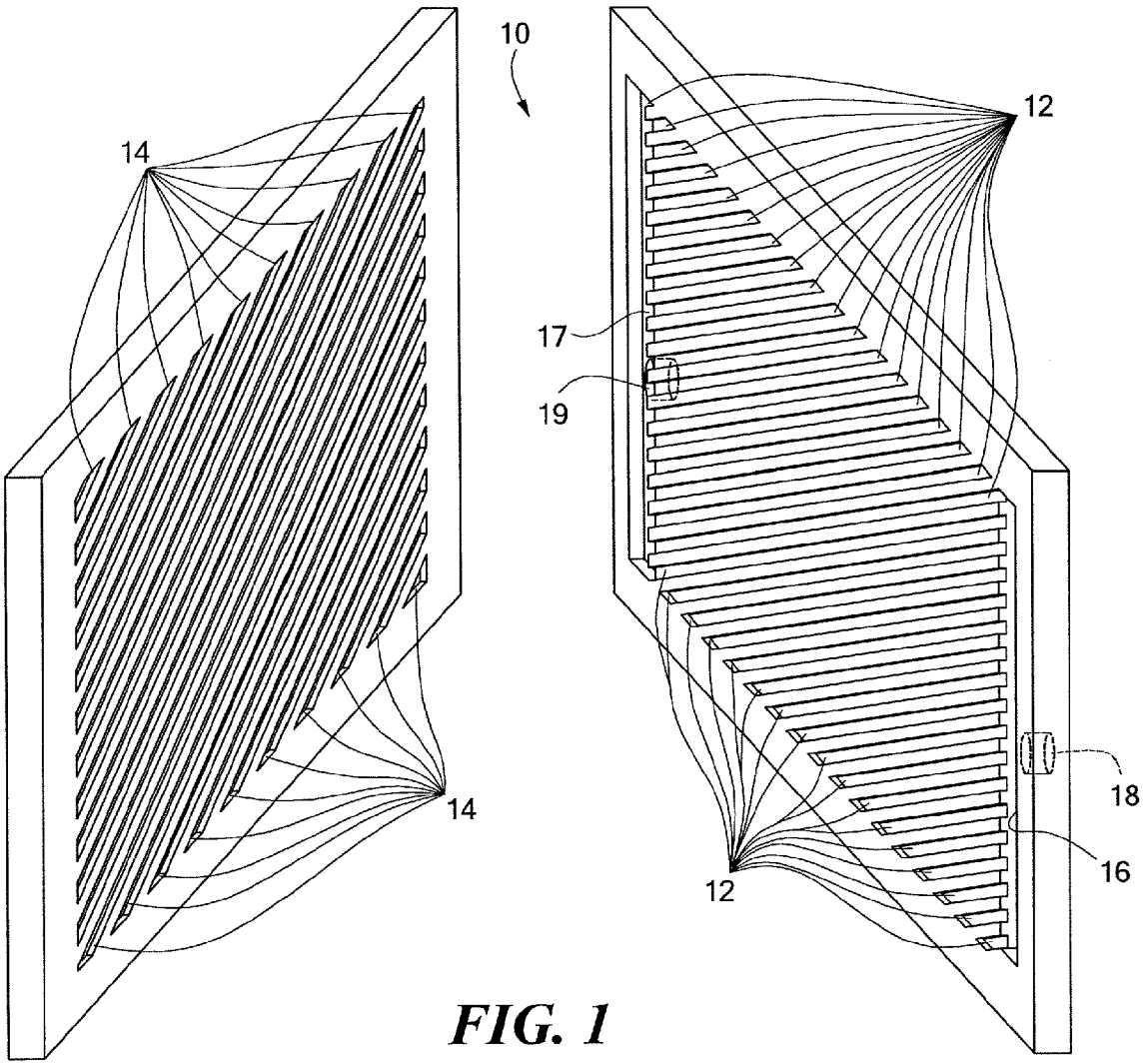
FIG. 1 shows the geometry of flow channels in a device including multiple plates adapted to include a pattern consistent with the disclosed system on one side.

FIG. 1 shows an example embodiment 10 of the disclosed cooling device. As shown in FIG. 1, a first set of channels 12 are defined by a first plate within the device 10, while a second set of channels 14 are defined by a second plate within the device 10. In the illustrative embodiment of FIG. 1, the flow channels 12 and 14 have been formed in corresponding copper plates to form the patterned plates stacked within the resulting device 10.

FIG. 1 further shows a fluid inlet port 18 allowing fluid to pass into the device, an input coolant distribution plenum 16 for passing fluid to the channels 12, and an output coolant distribution plenum 17 for collecting fluid from the channels 12 and passing the fluid to a fluid outlet port 19. While, for purposes of illustration, FIG. 1 shows inlet and outlet ports only with regard to the plate including the channels 12, the plate including the channels 14 may also include its own inlet and outlet ports.

Figure 4:
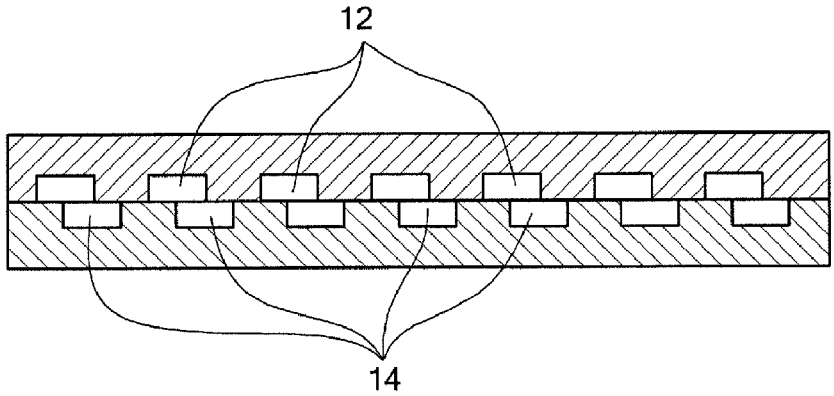
FIG. 4 shows a cross section of the plates of FIG. 1 arranges in a stack.

The illustrative embodiment shown in FIG. 1 illustrates how the fluid flow channels 12 and 14 of adjacent plates are arranged cross wise to each other when the plates are joined together. See also FIG. 4. Such an arrangement provides a generally up-and-down flow path and introduces turbulence into a liquid that is flowed through the device, thereby improving the thermal performance of the device 10.

The illustrative embodiment of FIG. 1 may be implemented as a two pass design, where a fluid inlet port and a fluid outlet port are located on the same end of the device 10. Alternatively, a single pass design may be used, in which inlet and outlet ports are configured on opposite ends of the device 10.

For purposes of explanation, the fluid flow channels 12 and 14 may have a depth of between 0.027 to 0.060 inches and a width of between 0.045 and 0.080 inches. The angle of the channels 12 may, for example, be between 18 and 30 degrees with respect to a lengthwise side of the device 10, while the angle of the channels 14 may be between negative 18 and negative 30 degrees with respect to that side of the device. The specific angles of and numbers of channels shown in the illustrative embodiments of FIGS. 1-3 are for purposes of illustration only, and the present invention may be embodied with numbers of channels and channel angles other than those shown.

Figure 2:
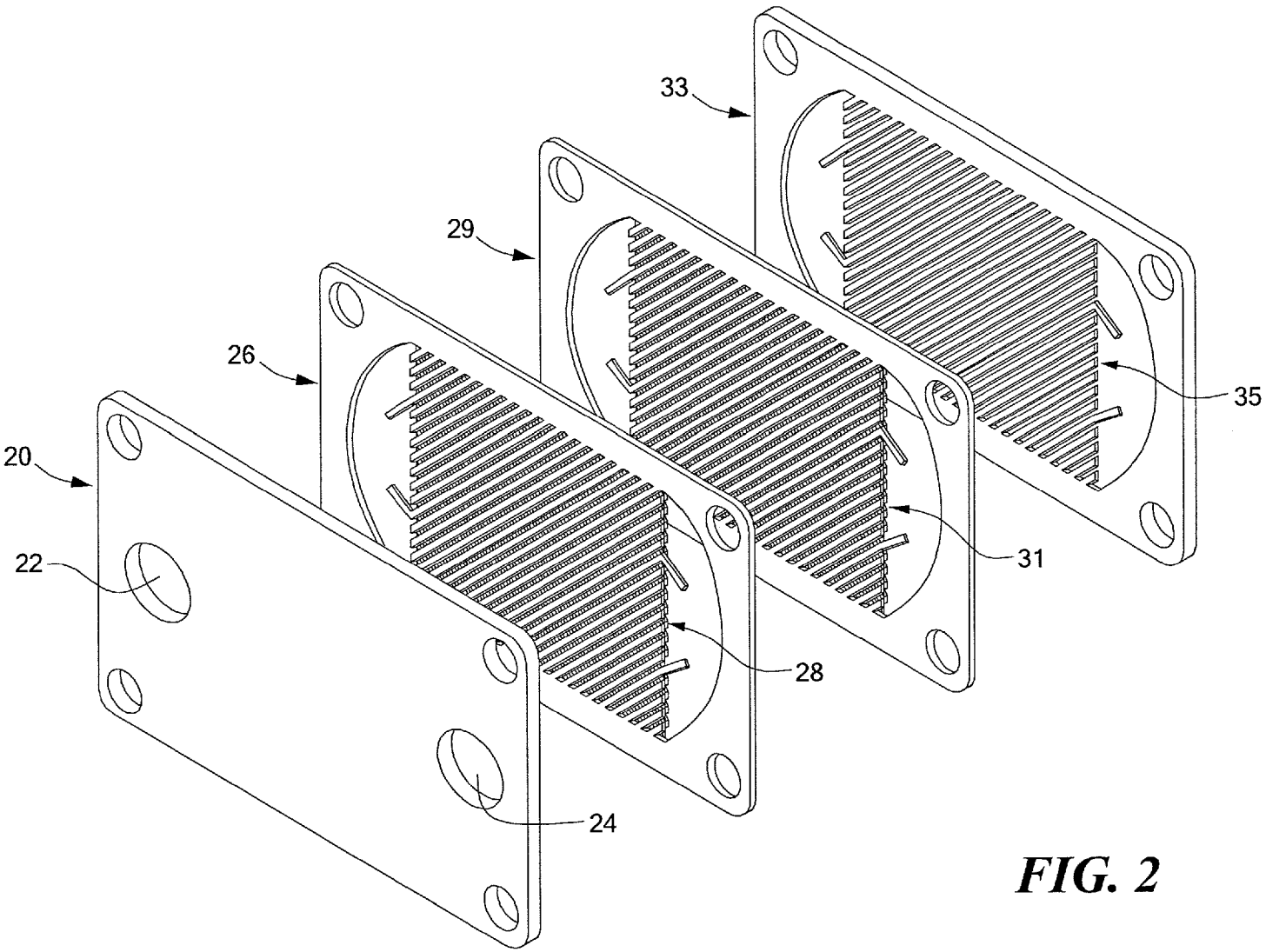
FIG. 2 shows the structure of the disclosed device in an alternative embodiment.
Figure 3:
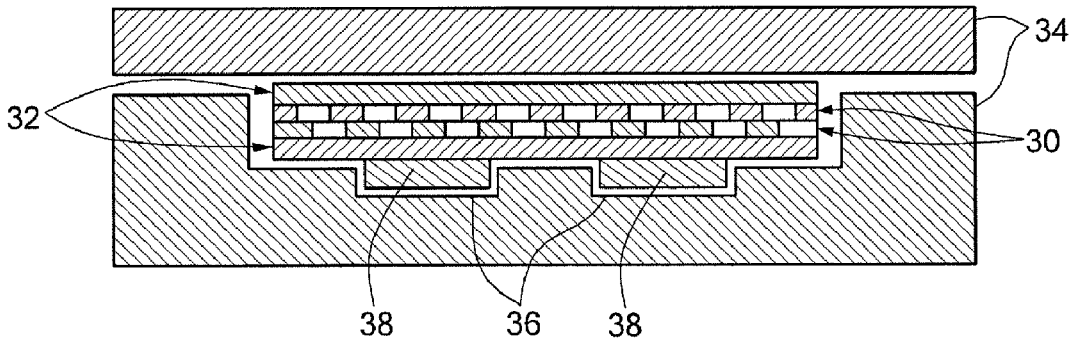
FIG. 3 shows a cross section of a diffusion bonding fixture that may be used to form a block of plates in accordance with an illustrative embodiment of the disclosed system.

FIG. 2 illustrates the assembly of an alternative embodiment of the disclosed system. As shown in FIG. 2, a first end plate 20 includes a fluid inlet port 22 and a fluid outlet port 24. A first plate 26 includes a patterned portion 28 defined by at least a first set of angled bars arranged crosswise defining a first set of fluid flow channels on a first side of the plate 26. The patterned portion 28 of the plate 26 may itself further include a second set of angled bars defining a second set of fluid flow channels arranged crosswise with respect to the first set of fluid flow channels on an opposite side of said plate 26. The angled bars of the patterned portion 28 are, for example, substantially rectangular, and extend in an angular fashion between the lengthwise sides of the plate 26. In the case where the patterned portion 28 defines two sets of fluid flow channels arranged crosswise to each other, then the plate 29 includes a similar patterned section 31 defining two sets of channels arranged crosswise with respect to each other. Alternatively, the plate 26 may only define one set of fluid flow channels extending angularly between its lengthwise sides, in which case the plate 29 would include a single set of fluid flow channels arranged crosswise with respect to the fluid flow channels of plate 26.

The angle of the flow channels may be any appropriate predetermined angle. For example, the angle of the flow channels in a first plate with respect to a given side of the device may be within a range of 18 to 30 degrees, and within a range of between −18 to −30 degrees in the adjacent plate with respect to the same side of the device. In this way, the channels of adjacent plates run criss-cross, or crosswise, at an angle to each other. The included angle with respect to the intersection of channels in adjacent plates may, accordingly, be within the range of 36 to 60 degrees.

Further as shown in FIG. 2, a second end plate 33 is used, having a patterned portion 35 etched therein defining some number of fluid flow channels. The first end plate 20, plates 26 and 29, and second end plate 33 are joined together through any appropriate means to form the alternative embodiment of the disclosed cooling device shown in FIG. 2.

In a method of manufacturing the disclosed cooling device, the disclosed device is assembled by diffusion bonding. The individual patterned plates are stacked in an alternating fashion such that the fluid flow channels of the pattern of each adjacent plate is crosswise with respect to its neighboring plate or plates. For example, each plate may be arranged in the stack so that its fluid flow channels are at a predetermined angle with respect to the fluid flow channels of its neighboring plates. The last plates put into the stack, which are stacked at the top and bottom of the assembly, are end plates which may or may not have an etched pattern, and which allow for input and output fluid ports. During operation of the disclosed device, the ports bring fluid into and out of the device.

During the disclosed manufacturing process, as shown in FIG. 3, the stacked patterned plates 30 and end plates 32 are placed in a fixture 34, and diffusion bonded in a vacuum or inert atmosphere. A mechanical load is applied to maintain contact pressure between the plates 30 and 32 during this process. The fixture 34 used for diffusion bonding the plates 30 and 32 together can also be designed or configured to provide for bonding various size pads or blocks to allow a method of offering "custom topography" to the surface interfacing with the components requiring cooling. This feature would eliminate an expensive machining operation. FIG. 3 shows a cross section of a diffusion bonding fixture, which has pockets 36 machined in place to precisely position the blocks 38 during soldering.

Figure 5:
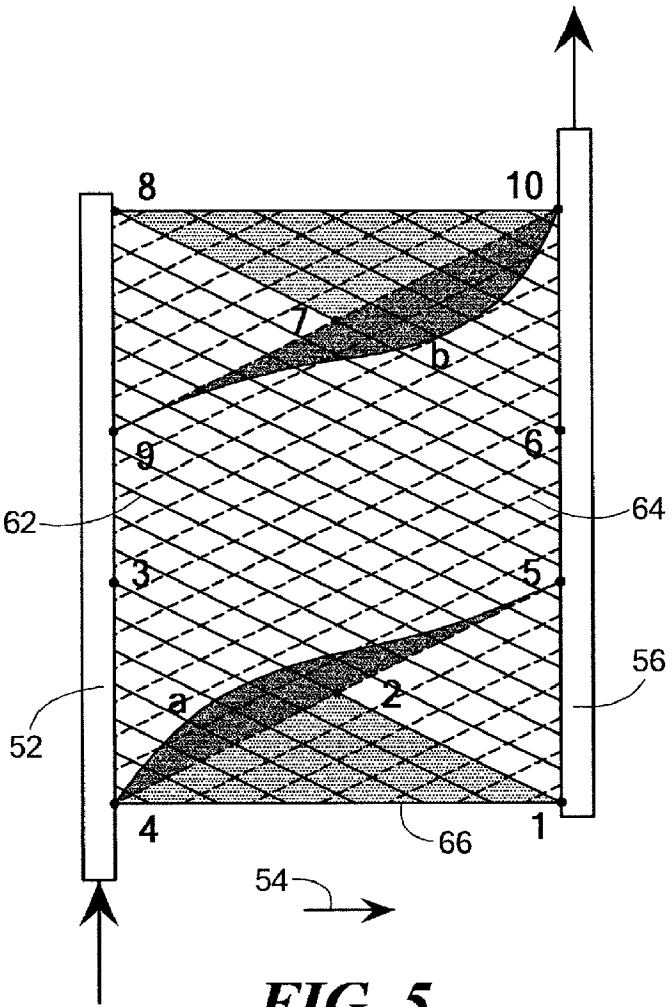
FIG. 5 is a schematic illustration of areas of reduced flow through a cold plate with crosswise channels.

In wider cold plates, the coolant flow through the crosswise channels may not become equally distributed over the full area of the cold plate. FIG. 5 is a schematic illustration in which coolant enters an input header 52 and exits the cold plate at output header 56, flowing in the overall direction of arrow 54. Channels in a top plate are indicated schematically by solid lines 62, and channels in a bottom plate, crosswise to the channels 62, are indicated schematically by dashed lines 64. It can be seen that some channels extend directly from the input header 52 to the output header 56. These channels are generally in the area bounded by lines connecting the numerals 1, 3, 8, 6, and 1 on one plate and 4, 5, 10, 9, and 4 on an adjacent plate. Other channels terminate along sidewalls 66 parallel to the overall direction 54 of flow. Flow in these channels is forced to change direction. Thus, the coolant instead tends to flow within the channels in the middle of the plate, leading to non-uniform cooling. The greatest flow reduction occurs in the areas indicated by lighter shading and bounded by lines connecting the numerals 4, 2, and 1, and the numerals 8, 7, and 10. Some flow reduction occurs in the areas indicated by darker shading and bounded by the curved line a and the line connecting numerals 4 and 5 and bounded by the curved line b and the line connecting numerals 9 and 10.

Figure 6:
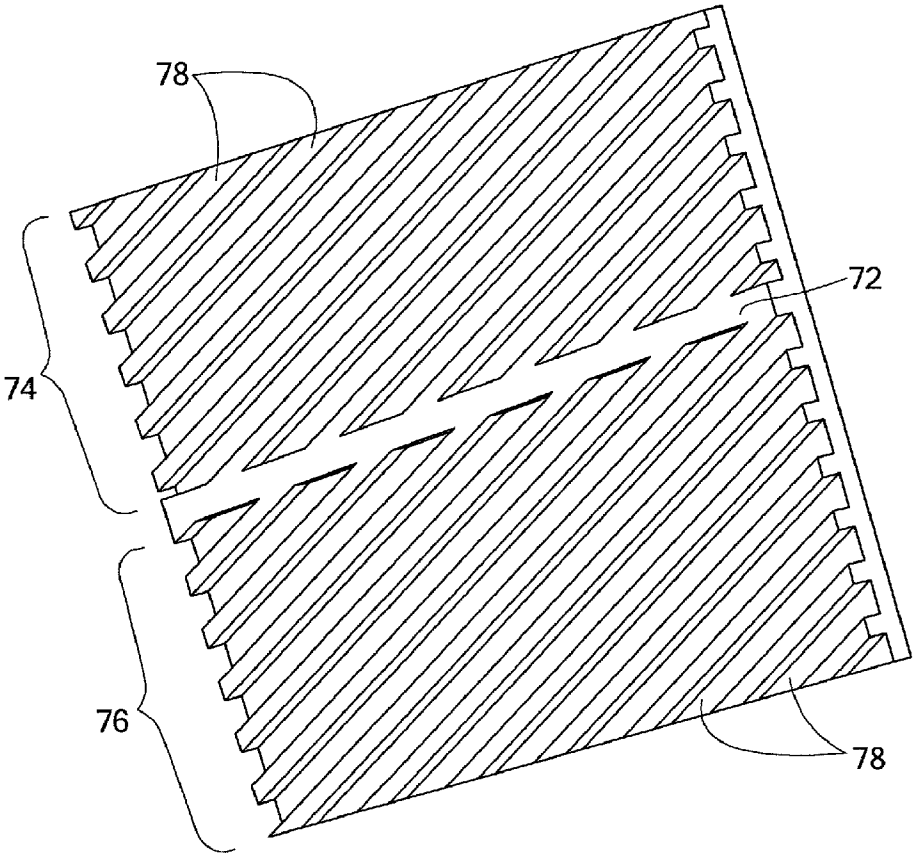
FIG. 6 is an isometric illustration of a cold plate incorporating a separation barrier according to the present invention.
Figure 7:
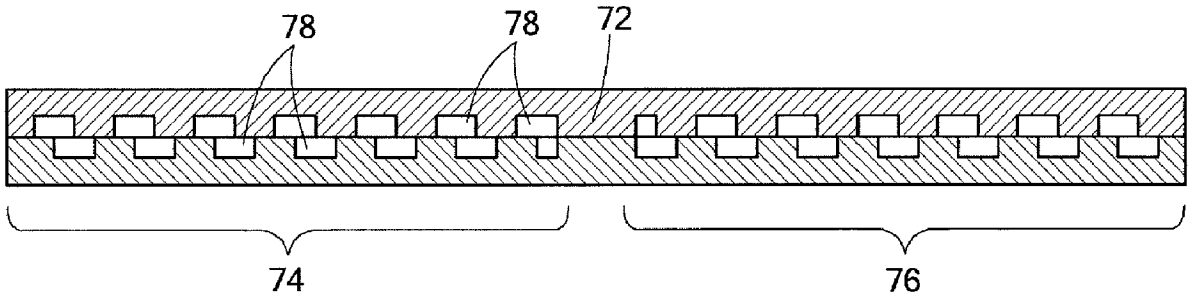
FIG. 7 is a cross section of two plates incorporating a separation barrier according to the present invention.

Accordingly, in a still further embodiment, illustrated in FIGS. 6 and 7, one or more separation barriers 72 extend along the plate parallel to the general direction of flow to separate the plate into two or more sections 74, 76 of crosswise flow channels 78. A portion of one plate incorporating such a barrier is indicated in FIG. 6. The barriers 72 are composed of wall portions that are aligned at an angle to the walls of the crosswise channels 72. Barriers on adjacent plates are aligned so that the upper surfaces of their wall portions abut when the plates are stacked, as indicated in FIG. 7. Coolant is introduced equally into all sections. However, where a barrier exists, coolant flow in one section cannot cross into another section. Spacing between the barriers depends on the length of the cold plate in the flow direction and the angle of the channels with respect to the flow direction. Preferably, the barriers are spaced such that there are no crosswise channels that extend directly from an input to an output. Rather, all crosswise channels should have one termination at a barrier or a sidewall. In this manner, flow is forced to pass into another crosswise channel before reaching the outlet.

Figure 10:
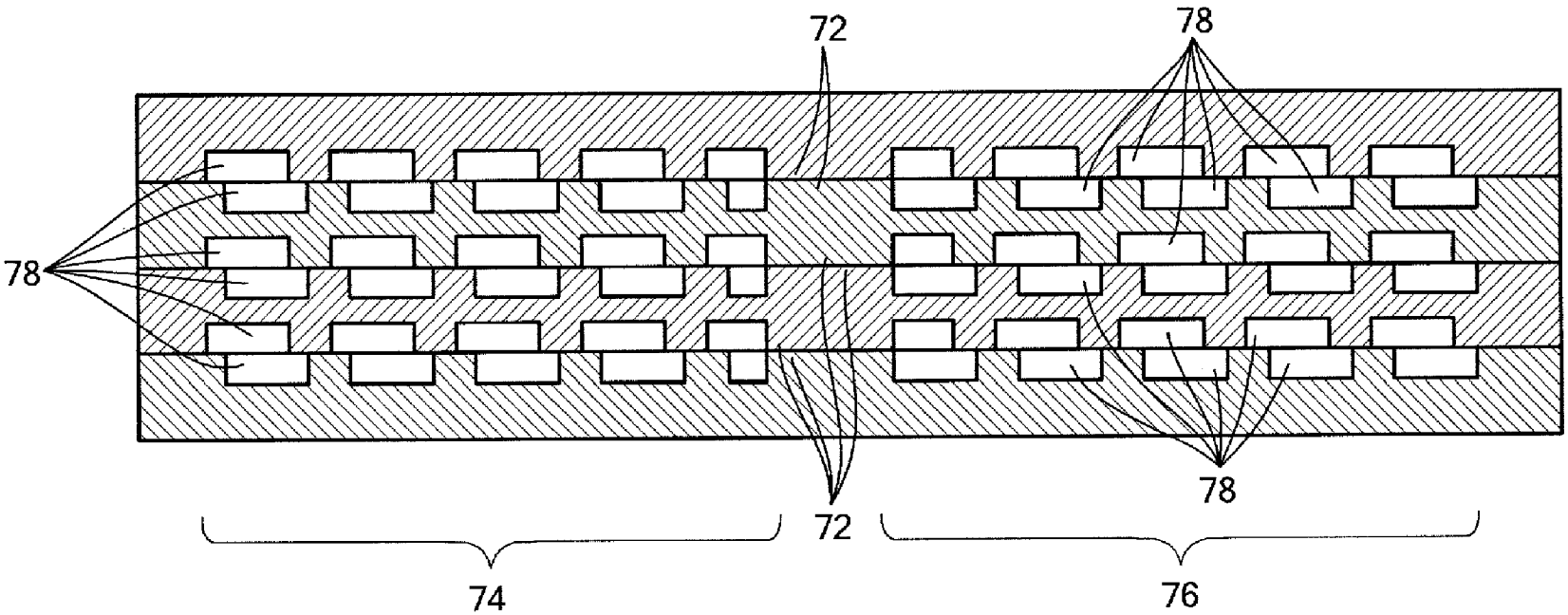
FIG. 10 is a cross section of an embodiment of a multi-pass cold plate incorporating separation barriers according to the present invention.
Figure 11:
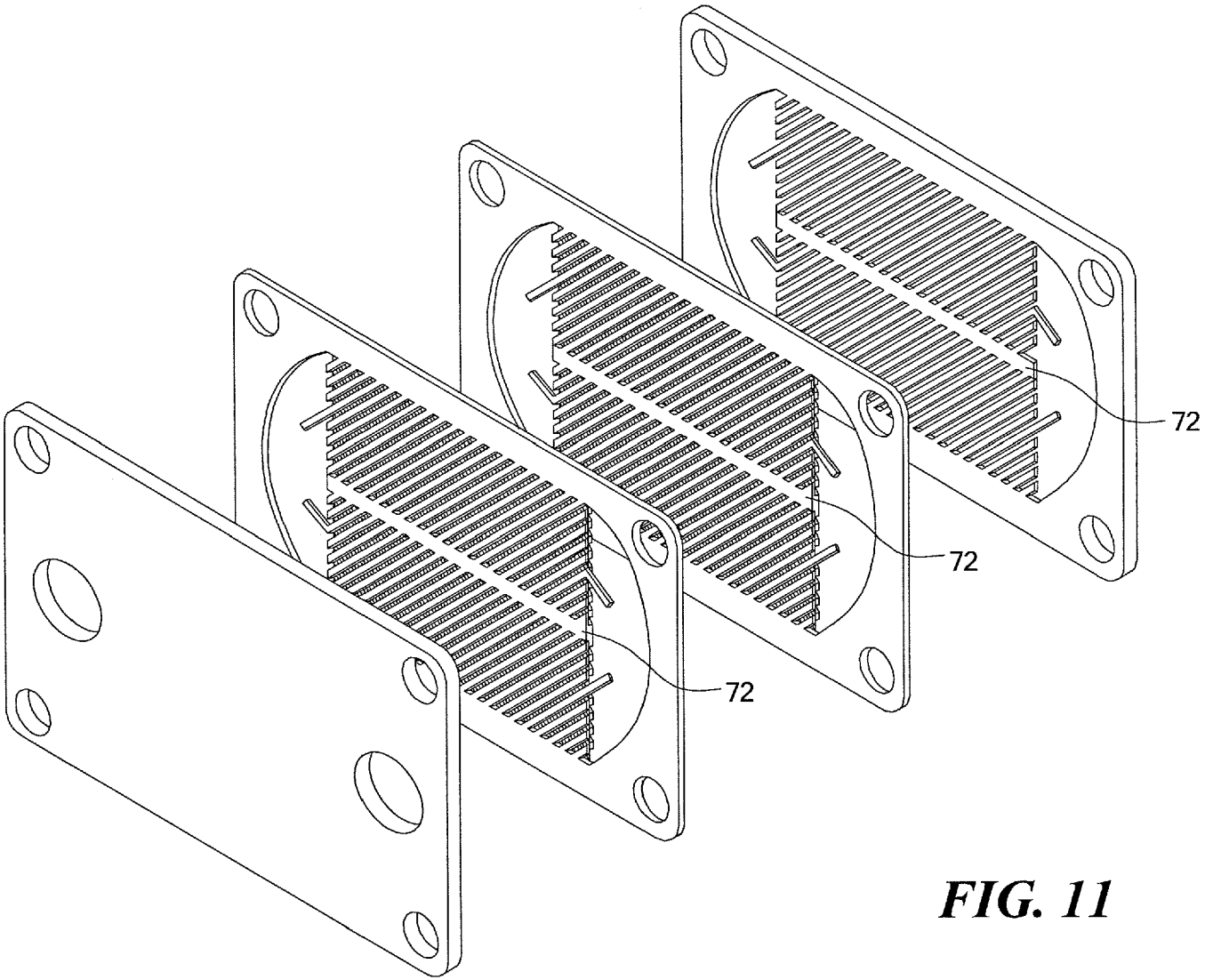
FIG. 11 is an exploded view of the embodiment of a multi-pass cold plate of FIG. 11.

The barriers preferably extend the full length of the plate, but they can extend less the full length of the plate. The barriers can be employed in single pass or multi-pass cold plates. FIGS. 10 and 11 illustrate an embodiment of a multi-pass cold plate.

Figure 8:
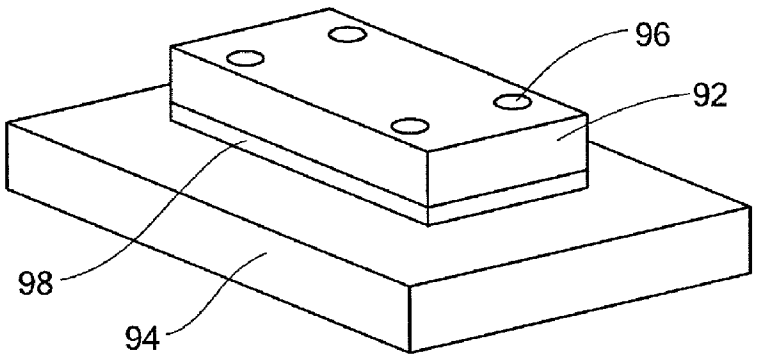
FIG. 8 PRIOR ART
FIG. 8 is a schematic illustration of a prior art cooling arrangement for a device.

Devices such as integrated gate bipolar transistors (IGBT) and other devices for high power generate a great deal of heat, for example, 100 to 2000 W of heat. Typically, such devices 92 are liquid cooled by a separate cold plate 94 that is attached via bolts 96 to the device, as illustrated in FIG. 8. A copper heat spreader 98 is provided on the bottom surface of the device to facilitate heat transfer to the separate cold plate.

Figure 9:
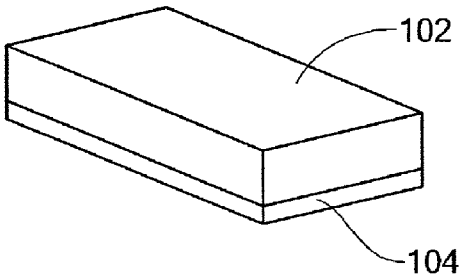
FIG. 9 is a schematic illustration of a cooling arrangement for a device incorporating the present invention.

The cold plate of the present invention can be integrally formed with the electronic device to be cooled. Referring to FIG. 9, a high power, heat generating device 102 is soldered directly to a cold plate 104 as described above. The present cold plate eliminates the thermal resistance between the heat spreader and the cold plate and eliminates the need to bolt the device down to a separate cold plate.

While the invention is described through the above exemplary embodiments, it will be understood by those of ordinary skill in the art that modification to and variation of the illustrated embodiments may be made without departing from the inventive concepts herein disclosed. Accordingly, the invention should not be viewed as limited except by the scope and spirit of the appended claims.

What is claimed is:

1. A cold plate cooling device, comprising:

a plurality of patterned plates, each of said patterned plates having a first side, a second side, and a thickness between the first side and the second side;

a channel pattern formed on the first side of each patterned plate, the channel pattern comprising a plurality of parallel channels, the channels of each plate being defined in part by walls extending from the first side to a depth less than the plate thickness such that the walls terminate short of the second side;

the channel pattern further comprising a barrier extending for at least a portion of the length of each patterned plate at an angle to the plurality of parallel channels, the barrier having an upper surface coplanar with said first surface, the barrier located intermediate edges of each plate such that at least a portion of the channels terminates at the barrier;

wherein the patterned plates are in a stack with the channel patterns of two plates abutting and the parallel channels of one plate arranged substantially crosswise with respect to the parallel channels of the other plate to provide a flow path for the coolant, and with the barrier of the one patterned plate arranged in abutment with the barrier of the other patterned plate to separate the flow path into at least two segments along at least a portion of the length of the flow path.

2. The cooling device of claim 1, wherein the barrier extends for the full length of each patterned plate.

3. The cooling device of claim 1, wherein said plates are arranged such that each of the channels of the pattern in the first one of the patterned plates are arranged at an included angle of between 36 and 60 degrees with respect to the channels of the other adjacent plate.

4. A cold plate cooling device comprising:

a plurality of patterned plates, each of said patterned plates having a first side, a second side, and a thickness between the first side and the second side;

a channel pattern formed on one of the first side and the second side of each patterned plate, the channel pattern comprising a plurality of parallel channels;

the channel pattern further comprising a barrier extending for at least a portion of the length of each patterned plate at an angle to the plurality of parallel channels; and a pair of end plates coupled to oppositesides of the device, wherein the end plates include an input port for allowing a fluid to enter the device and an output port for allowing a fluid to exit the device;

wherein the patterned plates are arranged in a stack with the channel patterns of two plates abutting and the parallel channels of one plate arranged substantially crosswise with respect to the parallel channels of the other plate to provide a flow path for the coolant, and with the barrier of the one patterned plate arranged in abutment with the barrier of the other patterned plate to separate the flow path into at least two segments along at least a portion of the length of the flow path; and wherein said plates are arranged such that each of the channels of the pattern in the first one of the patterned plates are arranged at an included angle of between 36 and 60 degrees with respect to the channels of the other adjacent plate.

5. The cooling device of claim 4, wherein the plurality of patterned plates are formed primarily of copper.

6. The cooling device of claim 1, wherein the barriers are spaced such that all parallel channels have a termination at one of the barrier or a sidewall of the patterned plates.

7. The cooling device of claim 1, wherein the channels in the pattern extend at an angle within the range of 18 to 30 degrees from a lengthwise side in the first one of the patterned plates.

8. The cooling device of claim 1, wherein the channels in the pattern extend at an angle within the range of negative 18 to negative 30 degrees from a lengthwise side in the other adjacent one of the patterned plates.

* * * * *